US010487786B2

(12) United States Patent
Carli et al.

(10) Patent No.: US 10,487,786 B2
(45) Date of Patent: Nov. 26, 2019

(54) FUEL INJECTION ASSEMBLY FOR AN INTERNAL COMBUSTION ENGINE

(71) Applicant: CONTINENTAL AUTOMOTIVE GMBH, Hannover (DE)

(72) Inventors: Daniele Carli, Pisa (IT); Filippo Falaschi, Fauglia (IT); Marco Pasquali, Leghorn (IT); Andrea Puccini, San Miniato (IT)

(73) Assignee: Vitesco Technologies GmbH, Hannover (DE)

( * ) Notice: Subject to any disclaimer, the term of this patent is extended or adjusted under 35 U.S.C. 154(b) by 134 days.

(21) Appl. No.: 15/663,090

(22) Filed: Jul. 28, 2017

(65) Prior Publication Data

US 2018/0038331 A1 Feb. 8, 2018

(30) Foreign Application Priority Data

Aug. 4, 2016 (EP) ..... 16182709

(51) Int. Cl.

| | |
|---|---|
| ***F02M 61/14*** | (2006.01) |
| ***F02M 55/00*** | (2006.01) |
| ***F02M 55/02*** | (2006.01) |
| ***F02M 61/16*** | (2006.01) |

(52) U.S. Cl.

CPC ..... *F02M 61/14* (2013.01); *F02M 55/005* (2013.01); *F02M 55/02* (2013.01); *F02M 61/168* (2013.01); *F02M 2200/853* (2013.01); *F02M 2200/856* (2013.01)

(58) Field of Classification Search

CPC .... F02M 61/14; F02M 61/168; F02M 55/005; F02M 55/02; F02M 2200/856; F02M 2200/853

USPC ..... 123/470

See application file for complete search history.

(56) References Cited

U.S. PATENT DOCUMENTS

| | | | | |
|---|---|---|---|---|
| 5,803,052 | A * | 9/1998 | Lorraine | F02M 61/145 123/456 |
| 5,970,953 | A | 10/1999 | Lorraine et al. | |
| 6,668,803 | B1 * | 12/2003 | McClean | F02M 61/14 123/456 |
| 6,874,477 | B1 * | 4/2005 | Lorraine | F02M 61/145 123/456 |

(Continued)

FOREIGN PATENT DOCUMENTS

| | | |
|---|---|---|
| CN | 103291516 A | 9/2013 |
| CN | 104179613 A | 12/2014 |

(Continued)

OTHER PUBLICATIONS

European Search Report dated Jan. 20, 2017 for counterpart European Patent Application No. 16182709.2.

(Continued)

*Primary Examiner* — Hia H Huynh

(57) ABSTRACT

A fuel injection assembly for an internal combustion engine has a fuel injector, an injector cup and a holding element for securing the fuel injector in the injector cup, wherein the fuel injector has an annular groove defined in part by an annular flange having a profiled peripheral surface engageable by a profiled surface on the arms of a holding element when the fuel injector is secured to the injector cup, to provide a line or point contact between the fuel injector and the holding element.

14 Claims, 2 Drawing Sheets

(56) References Cited

U.S. PATENT DOCUMENTS

| | | | |
|---|---|---|---|
| 8,408,184 | B2 | 4/2013 | Marc et al. |
| 8,479,710 | B2 | 7/2013 | Davis |
| 9,797,355 | B2 | 10/2017 | Reinhardt et al. |
| 10,125,733 | B1 * | 11/2018 | Mizuba ..... F16B 21/186 |
| 2010/0300406 | A1 | 12/2010 | Harvey et al. |
| 2013/0220276 | A1 | 8/2013 | Nakamura et al. |
| 2015/0330347 | A1 | 11/2015 | Pohlmann et al. |

FOREIGN PATENT DOCUMENTS

| | | | |
|---|---|---|---|
| JP | 2016504525 | A | 2/2016 |
| KR | 20100094427 | | 8/2010 |
| WO | WO2015135732 | A1 | 9/2015 |

OTHER PUBLICATIONS

Korean Office Action dated Aug. 30, 2018 for corresponding Korean patent application No. 10-2017-0088006.
Korean Office Action dated Mar. 25, 2019 for counterpart KR application 10-2017-00880006.
China Office Action dated May 15, 2019 for counterpart CN application 201710658713.

* cited by examiner

FUEL INJECTION ASSEMBLY FOR AN INTERNAL COMBUSTION ENGINE

CROSS REFERENCE TO RELATED APPLICATION

This application claims priority to European patent application No. 16182709.2 filed Aug. 4, 2016, the contents of which are hereby incorporated by reference herein.

FIELD OF INVENTION

The present disclosure relates to a fuel injection assembly for an internal combustion engine, particularly but not exclusively, to a fuel injection assembly for use with a high-pressure common rail fuel supply system for a multi-cylinder internal combustion engine. The disclosure also relates to a method of assembling a fuel delivery system incorporating a common rail fuel supply for a multi-cylinder engine.

BACKGROUND

A common rail fuel supply system includes a reservoir of fuel on the high-pressure typically in the form of an elongate tube having a fuel reservoir which is also known as a main gallery. Fuel injectors, typically one per cylinder, are connected to the common rail at spaced intervals through an injector cup which is typically connected mechanically and hydraulically directly to the common rail. In a known system, the fuel injector is located in the injector cup and is secured in position in the injector cup by means of a connection plate which is coupled to the fuel injector cup through two bolts. This known arrangement worked satisfactorily but has the disadvantage that it requires a significant amount of space in an environment such as in a vehicle where space is extremely limited. There are also difficulties in ensuring that process parameters such as the tightening torque on the bolts is accurately carried out. As a result, this solution is expensive and time consuming to assemble and not suitable for many applications. U.S. Pat. No. 8,479,710 B2 discloses a fuel injector system in which a coupling structure is provided for coupling a fuel injector to an injector cup, in which the cup has diametrically opposite slots in a peripheral wall for receiving clips which engage an injector to locate the injector in the cup. The clips are held in position by a retainer band which is fastened over the clips. The use of these several components is costly, complicates assembly and mitigates against subassembly of the components since the components need to be held in position on the cup for transportation but have to be disassembled for the injector to be inserted. A further problem arises in that it is desirable for the injector to pivot slightly in the cup and to maintain contact with the securing device in order to prevent radial loads on the injector generated by the fuel pressure during the fuel injection phase.

SUMMARY

According to example embodiments of the present invention, there is provided a fuel injection assembly for an internal combustion engine, the assembly having a longitudinal axis and including an elongate fuel injector, an injector cup and a holding element for securing the fuel injector to the injector cup. The injector cup extends along the longitudinal axis, the injector cup and has an upper end and a lower end, the injector cup having a recess in its lower end adapted to receive a fuel inlet port of the fuel injector such that a fuel outlet port of the injector projects from the lower end of the injector cup, a first opening or openings being formed in the peripheral wall of the injector cup for receiving the holding element. The holding element is generally U-shaped having two generally parallel arms adapted to engage opposite sides of an annular groove in the fuel injector to secure the fuel injector in the injector cup. The annular groove is defined in part by an annular flange having a profiled surface engageable by a profiled surface on the arms of the holding element when the fuel injector is secured to the injector cup, to provide a line or point contact between the fuel injector and the holding element.

It can be seen that the side of the flange defining the groove is curved both by the radius of the fuel injector and the curve of the flange perpendicular to the radius to provide a profiled surface, including a part spherical contact surface which engages with the profiled surface, including a flat planar surface, of the chamfer on the holding element. In this way, a point or line contact is provided between the fuel injector and the holding element which enables the injector to easily pivot relative to the holding element and the injector cup. This effectively prevents radial loads being applied to the injector when it is mounted into the engine and subjected to fuel pressure. Furthermore, the part spherical-to-plane contact facilitates the ease of positioning the correct angular position of the fuel injector relative to the injector cup during initial assembly. Thus, the present arrangement provides an improved method of providing a suspended fuel injector system compared to the known solutions and does so in an efficient and economical way.

Preferably, the injector cup has a further opening or openings diametrically opposite the first opening for receiving the outer ends of the two arms.

In an example embodiment, the holding element has a part adapted to abut the outer surface of the injector cup when inserted therein to define the installed position of the holding element.

A further embodiment includes an indexing clip which has resilient arms engageable with an engagement surface on the injector cup to locate the clip accurately on the cup and further including a protrusion projecting generally perpendicularly from the resilient arms and engageable in a recess in the fuel injector to lock the fuel injector in a desired angular position relative to the injector cup.

BRIEF DESCRIPTION OF THE DRAWINGS

An embodiment in accordance with the disclosure will now be described by way of example with reference to the drawings, in which.

DETAILED DESCRIPTION

In this description reference is made to upper and lower ends but this nomenclature is used solely for descriptive convenience. In the installed condition, the orientation of the assembly depends upon the particular configuration.

Figure 2:
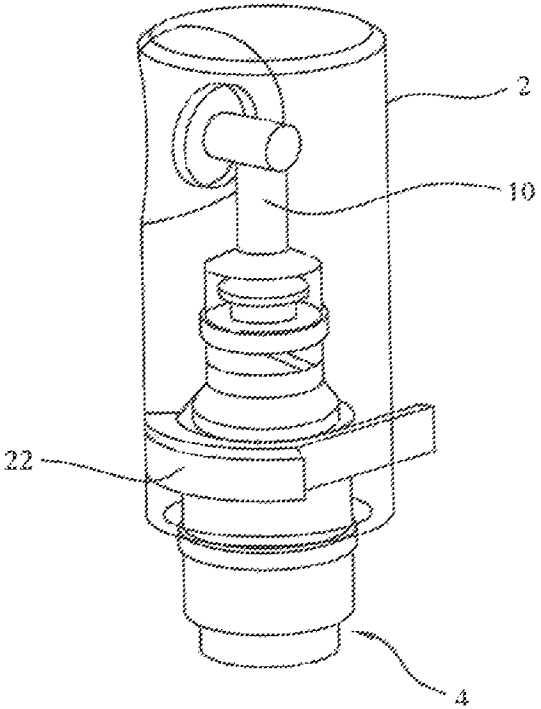
FIG. 2 shows a perspective view of the assembly of FIG. 1.
Figure 1:
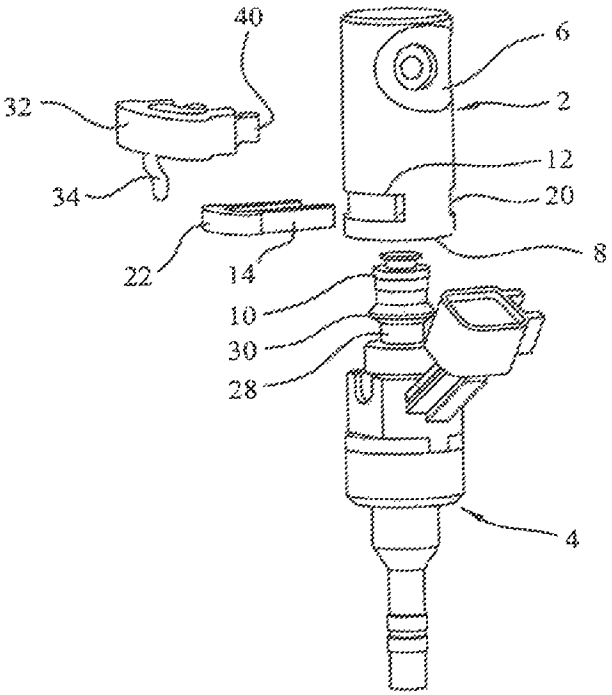
FIG. 1 shows an exploded view of a fuel injector cup and fuel injector assembly.

FIGS. 1 and 2 show a fuel injector cup 2 for receiving a fuel injector 4, the cup including a generally cylindrical body having, in this embodiment, an arcuate cutaway 6 adjacent its upper end through which the cup 2 is fastened to a tubular fuel rail (not shown) in a mechanically secure and hydraulically fluid tight manner. In alternative embodiments (not shown), the cup may be fastened to the fuel supply by alternative connections such as a connection on its top face. At its lower end the cup 2 has an opening for receiving the fuel inlet 10 of the fuel injector 2. The fuel injector inlet 10 engages with the hydraulic connection to the fuel rail to provide a direct fuel path between the common rail reservoir and the injector 4.

The injector cup 2 has, adjacent its lower end, at least one spaced slot 12 adapted to receive in a push fit, for manual assembly, respective arms 14 of a holding element 16, to be described with reference to FIG. 3, and on the opposite side of the cup 2 there is at least one supporting slot through which the outer ends 18 of the arms 14 pass. The arms 14 are resilient and their outer ends 18 are arranged to deflect against the resilience as they enter the supporting slots 20 to firmly hold the holding element 4 in position in the injection cup.

Figure 3:
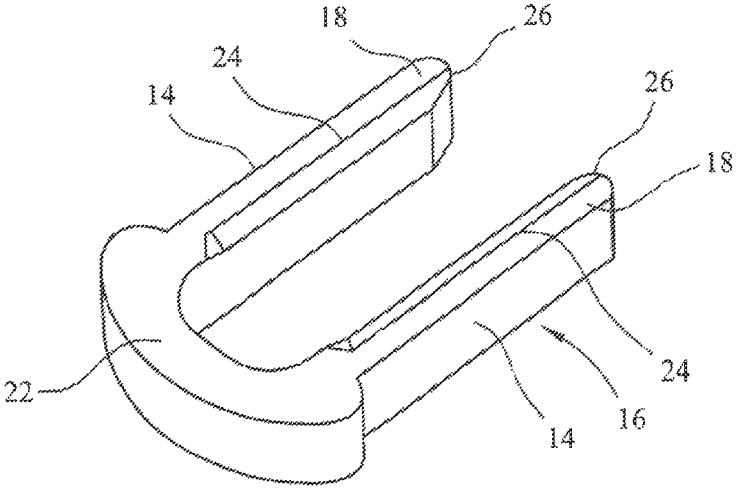
FIG. 3 shows a perspective view of a holding element.

Referring now to FIG. 3, there is shown a perspective view of the holding element 16 which is a U-shaped member and has two generally parallel arms 14 joined by a web 22 which, in this embodiment, is curved with a radius substantially the same as the circumferential radius of the injector cup 2. The web 22 abuts the outer surface of the injector cup to determine that the holding element is fully inserted. The holding element 16 is formed of a resilient metal material. On their inner top edges (as shown) each arm 14 has a profiled surface in the form of a chamfer 24 along its length to form a surface at an angle to the faces of the arms. The chamfer surface 24 may be flat or may be a convex or similar curve.

The inner edges of the outer ends 18 of the arms 14 each have a chamfer which serve to guide the arms into the supporting slots, the slots being positioned and dimensioned to deflect the arms outwardly against the resilient bias to thereby secure the holding element 16 firmly in position.

Referring now to FIG. 1, the fuel injector 4 has a peripheral annular groove 28 into which the arms 14 of the holding element 16 engage on opposite sides of the injector 4. On its upper side the groove 28 is defined by a flange 30 which has a profiled surface, which may be arcuate, both about the axis of the injector and about an axis perpendicular to the injector axis. When the holding element 16 is inserted, the chamfer 24 contacts the curved profile on the flange 30. Because of the curved profile only a point or line contact is made between the fuel injector 4 and the holding element 16 and this enables the fuel injector 4 to pivot easily during assembly to a position where radial forces on the injector 4 during fuel injection are minimised.

In order to ensure that the fuel injector 4 has the correct angular alignment in the combustion chamber to ensure the correct spray orientation during injection, an indexing clip 32 is provided formed of a metal, although in other embodiments it may be formed of a plastics material, the clip 32 having two resilient arms 40 which wrap round the outside of the injector cup 2 and engage in recesses or orifices in the cup wall to accurately locate the clip 32 on the injector cup 2. The clip 32 further engages the web 22 of the holding element 16 to prevent the holding element from moving out of the injector cup 2. The indexing clip 32 has a downwardly extending protrusion 34 which, during assembly by pivoting the fuel injector relative to the cup enables the protrusion 34 to engage with a recess 36 in the fuel injector body to thereby accurately secure the injector 4 in the correct angular position.

Figure 5:
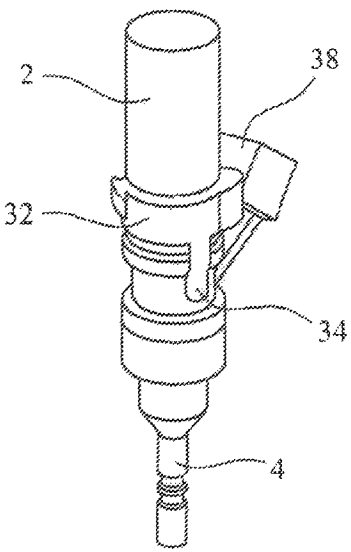
FIG. 5 shows an external view of the fuel injector cup and fuel injector assembly.
Figure 4:
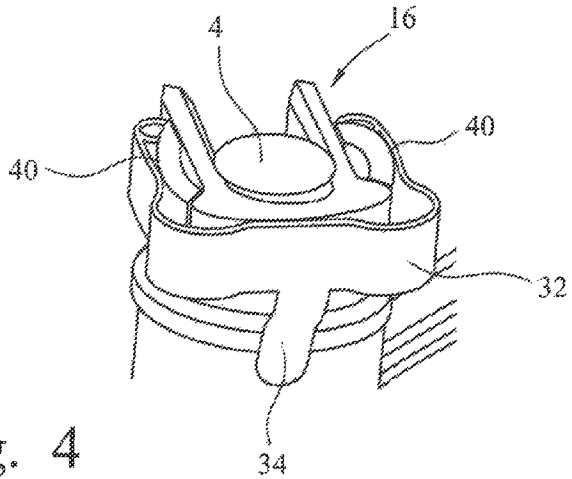
FIG. 4 shows a scrap view of the holding element and an indexing clip.

FIG. 5 shows the injector cup 2 and fuel injector 4 in the assembled condition with the fuel injector 4 extending from the injector cup 2 so as to enter the combustion chamber when the injector cup 2 is secured to the engine. This arrangement is referred to as a suspended injector system in which the injector is not mechanically connected to the engine. This results in less transmission of noise from the fuel injection process. The indexing clip 32 accurately locating the injector 4 is shown together with an electrical connection block 38 for supplying the electrical fuel injection control signals.

The present disclosure greatly facilitates assembly compared with known arrangements, since once the fuel injector 4 is pushed into the injector cup 2, the holding element 16 is pushed into place, and the indexing clip 32 is clipped over the injector cup to align the fuel injector and the assembly is complete.

The invention claimed is:

1. A fuel injection assembly for an internal combustion engine having a longitudinal axis, the fuel injection assembly comprising:

an elongate fuel injector having a fuel inlet port, a fuel outlet port, an annular groove and an annular flange;

an injector cup;

a holding element for securing the fuel injector in the injector cup; and a plurality of spaced slots integrally formed as part of the injector cup;

wherein the injector cup extends along the longitudinal axis, the injector cup has an upper end, a lower end and a peripheral wall, the injector cup having an opening in a lower end thereof configured to receive the fuel inlet port of the fuel injector such that the fuel outlet port of the fuel injector projects from the lower end of the injector cup, the holding element being generally U-shaped having two generally parallel arms, each of which is engaged with a corresponding one of the plurality of spaced slots, and the two generally parallel arms configured to engage opposite sides of the annular groove in the fuel injector to secure the fuel injector in the injector cup, each arm of the holding element including a profiled surface; and wherein the annular groove is defined in part by the annular flange having a profiled surface engageable by the profiled surfaces of the arms of the holding element when the fuel injector is secured to the injector cup, to provide a line or point contact between the fuel injector and the holding element.

2. The fuel injection assembly according to claim 1, wherein the profiled surface of the flange is curved in two mutually perpendicular planes.

3. The fuel injection assembly according to claim 1, wherein the profiled surface on the arms of the holding element comprises a chamfer inclined relative to an upper surface of the respective arm.

4. The fuel injection assembly according to claim 1, in which the injector cup has a further opening or openings diametrically opposite the first opening for receiving the outer ends of the two arms.

5. The fuel injection assembly according to claim 1, wherein the holding element has a part configured to abut an outer surface of the injector cup when inserted therein to define an installed position of the holding element.

6. The fuel injection assembly according to claim 5, wherein the part of the holding element configured to abut the outer surface of the injector cup comprises a web joining the two arms.

7. The fuel injection assembly according to claim 1, further including an indexing clip which has resilient arms engageable with an engagement surface on the injector cup to locate the indexing clip accurately on the cup and further including a protrusion projecting generally perpendicularly from the resilient arms and engageable in a recess in the fuel injector to lock the fuel injector in a desired angular position relative to the injector cup.

8. A fuel injection assembly for an internal combustion engine, the fuel injection assembly comprising:

a fuel injector having a fuel inlet port, a fuel outlet port, an annular groove and an annular flange;

an injector cup including an upper end, a lower end, a peripheral wall, and an opening defined in a lower end thereof which is configured to receive the fuel inlet port of the fuel injector such that the fuel outlet port of the fuel injector projects from the lower end of the injector cup;

a holding element configured to secure the fuel injector in the injector cup; and a plurality of spaced slots integrally formed as part of the injector cup;

wherein the holding element being generally U-shaped having two generally parallel arms, each of which is engaged with a corresponding one of the plurality of spaced slots, and the two generally parallel arms to engage opposite sides of the annular groove in the fuel injector to secure the fuel injector in the injector cup;

wherein the annular groove is defined in part by the annular flange having a profiled surface which is configured to engage the arms of the holding element when the fuel injector is secured to the injector cup, so as to provide a line or point contact between the fuel injector and the holding element.

9. The fuel injection assembly according to claim 8, wherein the profiled surface of the flange is curved in two mutually perpendicular planes.

10. The fuel injection assembly according to claim 8, wherein each of the arms of the holding element includes an upper surface and a profiled surface, each profiled surface of the arms of the holding element comprising a chamfer inclined relative to the upper surface of the respective arm.

11. The fuel injection assembly according to claim 8, wherein the injector cup has a further opening or openings diametrically opposite a first opening of the injector cup, the further opening or openings configured to receive outer ends of the two arms.

12. The fuel injection assembly according to claim 8, wherein a part of the holding element abuts an outer surface of the injector cup when inserted therein to define an installed position of the holding element.

13. The fuel injection assembly according to claim 12, wherein the part of the holding element comprises a web joining the two arms.

14. The fuel injection assembly according to claim 8, wherein the injector cup includes an engagement surface, and the fuel injection assembly further comprises an indexing clip which has resilient arms for engaging the engagement surface the injector cup to locate the indexing clip on the cup, the indexing clip including a protrusion projecting generally perpendicularly from the resilient arms to engage in a recess in the fuel injector to lock the fuel injector in a desired angular position relative to the injector cup.

* * * * *